US008190050B2

(12) United States Patent
Jeon et al.

(10) Patent No.: US 8,190,050 B2
(45) Date of Patent: May 29, 2012

(54) IMAGE FORMING APPARATUS HAVING A MOUNTING/DEMOUNTING STRUCTURE

(75) Inventors: In Cheol Jeon, Yongin-si (KR); Sung Gi Kim, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 934 days.

(21) Appl. No.: 12/173,142

(22) Filed: Jul. 15, 2008

(65) Prior Publication Data

US 2009/0214248 A1 Aug. 27, 2009

(30) Foreign Application Priority Data

Feb. 21, 2008 (KR) ..... 10-2008-0015800

(51) Int. Cl.
*G03G 15/00* (2006.01)

(52) U.S. Cl. ..... 399/90; 399/111

(58) Field of Classification Search ..... 399/90, 399/111

See application file for complete search history.

(56) References Cited

U.S. PATENT DOCUMENTS

| | | | | |
|---|---|---|---|---|
| 4,500,195 | A * | 2/1985 | Hosono | |
| 5,585,889 | A | 12/1996 | Shishido et al. | |
| 7,693,450 | B2 * | 4/2010 | Kim et al. | |
| 2002/0041774 | A1 * | 4/2002 | Higeta et al. | |
| 2004/0009008 | A1 | 1/2004 | Park et al. | |
| 2006/0029416 | A1 * | 2/2006 | Oguma et al. | 399/90 |
| 2007/0065176 | A1 * | 3/2007 | Kim et al. | |

FOREIGN PATENT DOCUMENTS

| | | |
|---|---|---|
| CN | 1384405 | 12/2002 |
| EP | 1253485 | 10/2002 |
| GB | 2190757 | 11/1987 |
| JP | 04-96073 | 3/1992 |
| KR | 2007-87738 | 8/2007 |

OTHER PUBLICATIONS

Korean Office Action dated Aug. 10, 2009 issued in KR Application No. 2008-15800.

Korean Notice of Submission of Opinion dated Aug. 10, 2009 issued in KR Application No. 2008-15800.

Chinese Office Action issue Oct. 8, 2010 in CN Application No. 200810170901.

European Search Report dated Sep. 16, 2009 issued in EP Application No. 08165976.5.

* cited by examiner

*Primary Examiner* — David Gray
*Assistant Examiner* — Laura Roth
(74) *Attorney, Agent, or Firm* — Stanzione & Kim, LLP

(57) ABSTRACT

An image forming apparatus having a mounting/demounting structure between a main body and an image carrying unit. The image forming apparatus includes a main body provided with a first electrical connecting part, an image carrying unit removably mounted in the main body and provided with a second electrical connecting part, and a guide device to guide the image carrying unit in an insertion direction and a lateral direction so that the second electrical connecting part of the image carrying unit is connected to the first electrical connecting part of the main body.

18 Claims, 6 Drawing Sheets

IMAGE FORMING APPARATUS HAVING A MOUNTING/DEMOUNTING STRUCTURE

CROSS-REFERENCE TO RELATED APPLICATIONS

This application claims the benefit of Korean Patent Application No. 2008-0015800, filed on Feb. 21, 2008 in the Korean Intellectual Property Office, the disclosure of which is incorporated herein by reference in its entirety.

BACKGROUND OF THE INVENTION

1. Field of the Invention

The present general inventive concept relates to an image forming apparatus, and more particularly, to an image forming apparatus having an improved mounting/demounting structure between a main body and removable units, thereby enhancing mounting performance.

2. Description of the Related Art

An image forming apparatus refers to an apparatus that prints an image on a printing medium according to an input image signal. An image forming apparatus is classified as a printer, a copying machine, a fax machine, a multi-function printer which has multiple functions of printing, scanning, copying and faxing, and the like.

As one type of the image forming apparatus, an electrophotographic type image forming apparatus is configured such that light is scanned to a photosensitive body charged to a predetermined electric potential to form an electrostatic latent image on a surface of the photosensitive body, and the electrostatic latent image is developed into a visible image by means of a developing unit supplying a developer to the electrostatic latent image. The visible image formed on the photosensitive body is directly transferred onto a printing medium, or is transferred onto a printing medium via an intermediate transfer unit. The image transferred onto the printing medium is then fused to the printing medium through a fusing process. Any residual developer on the photosensitive body without being transferred onto the printing medium or the intermediate transfer unit in the transfer process is collected by a cleaning unit, and is stored in a developer storage unit.

In such an image forming apparatus, a photosensitive body unit, a developing unit, a transfer unit and a developer storage unit are removably mounted in a main body which forms an exterior appearance of the image forming apparatus, so as to be replaced or repaired. In order to sense whether such removable units are in the main body or not and to control the removable units, the image forming apparatus includes contacts provided at the removable units, and terminals provided at the inner surface of the main body to be electrically connected to the contacts. The terminals protrude from the inner surface of the main body, and can move forward and backward within a predetermined range.

However, because lateral movement of the removable units is restrained and a user should push or pull the removable units into/out of the main body in a forward/backward direction, the above-constituted conventional image forming apparatus has problems of abrasion or damage of the terminals provided at the main body due to the removable units.

Also, because interference, such as friction or latching, between the main body and the removable units is severely generated, a user has a poor handling feeling when mounting or demounting the removable units.

SUMMARY OF THE INVENTION

The present general inventive concept provides an image forming apparatus having an improved mounting/demounting structure between a main body and removable units and thus capable of decreasing abrasion and preventing damage of terminals provided at an inner surface of the main body.

The present general inventive concept also provides an image forming apparatus capable of making a user have a smooth handling feeling when mounting or demounting removable units.

Additional aspects and/or advantages of the general inventive concept will be set forth in part in the description which follows and, in part, will be obvious from the description, or may be learned by practice of the general inventive concept.

The foregoing and/or other aspects and utilities of the present general inventive concept are achieved by providing an image forming apparatus including: a main body provided with a first electrical connecting part; an image carrying unit removably mounted in the main body, the image carrying unit being provided with a second electrical connecting part; and a guide device to guide the image carrying unit in an insertion direction and a lateral direction so that the second electrical connecting part of the image carrying unit is connected to the first electrical connecting part of the main body.

The guide device may include at least one convex part provided at any one of the main body and the image carrying unit, and at least one concave part provided at the other one of the main body and the image carrying unit, in which the convex part is fitted and guided.

The convex part may be extended in the insertion direction.

The concave part may include a first guide portion and a second guide portion, and the image carrying unit may be guided in a slant line direction in the first guide portion, and then may be guided in the insertion direction in the second guide portion.

The first electrical connecting part may be configured as a contact provided at a side portion of the image carrying unit, and the second electrical connecting part may be configured as a terminal provided at an inner side surface of the main body, movably forward and backward from the inner side surface.

The concave part may be provided at the image carrying unit, and may include two side surfaces, a first guide portion and a second guide portion defined by the side surfaces. One side surface of the concave part, which is positioned closer to the contact than the other side surface, may gradually move away from the side portion mounted with the contact of the image carrying unit as it goes from an inlet of the first guide portion to an inlet of the second guide portion, and may be formed parallel to the side portion of the image carrying unit in the second guide portion.

The concave part may be provided at the main body, and may include two side surfaces, a first guide portion and a second guide portion defined by the side surfaces. One side surface of the concave part, which is positioned more distant from the terminal than the other side surface, may gradually get closer to the inner side surface mounted with the terminal of the main body as it goes from an inlet of the first guide portion to an inlet of the second guide portion, and may be formed parallel to the inner side surface of the main body in the second guide portion.

The image carrying unit may include an expanded portion in which a width is expanded.

The image forming apparatus may further include a moving member provided at an opening portion of an inner side surface mounted with the first electric connecting part of the main body.

The foregoing and/or other aspects and utilities of the present general inventive concept may also be achieved by providing an image forming apparatus including: a main body; a removable unit removably mounted in the main body; a contact provided at a portion of the removable unit; a terminal provided at an inner side surface of the main body, the terminal being connected to the contact when the removable unit is in the main body; and a guide device to guide the removable unit to a mounting position. By the guide device, the removable unit begins being inserted into the main body while the removable unit is spaced apart from the terminal in a lateral direction, and then is connected to the terminal when the removable unit closely approaches the mounting position.

The guide device may include a first guide portion and a second guide portion. The removable unit may be moved in an insertion direction and a lateral direction in the first guide portion, and may be moved in the insertion direction in the second guide portion.

The guide device may include at least one rail part provided at any one of the removable unit and the main body, and at least one concave part provided at the other one of the removable unit and the main body, in which the rail part is fitted and guided.

The concave part may have a width which gradually decreases in a predetermined region and is uniform from the predetermined region in a direction of inserting the rail part into the concave part.

The foregoing and/or other aspects and utilities of the present general inventive concept may also be achieved by providing an image carrying unit removably mounted in a main body of an image forming apparatus, the image carrying unit including: a contact provided at a portion of the image carrying unit; and a guide device to guide the image carrying unit to be moved in an insertion direction and a lateral direction so that the contact is connected to a terminal provided at the main body of the image forming apparatus.

The guide device may include a concave part in which a convex part provided at the main body of the image forming apparatus is fitted.

The image carrying unit may be formed integrally with a developer storage unit.

The foregoing and/or other aspects and utilities of the present general inventive concept may also be achieved by providing a removable unit removably mounted in a main body of an image forming apparatus, the removable unit including: a contact provided at a side portion of the removable unit, the contact being connected to a terminal provided at the main body when the removable unit is in the main body; and a concave part connected with a convex part provided at the main body to guide the removable unit to a mounting position. By the concave part, the removable unit begins being inserted into the main body while the removable unit is spaced apart from the terminal in a lateral direction, and then is connected to the terminal when the removable unit closely approaches the mounting position.

The foregoing and/or other aspects and utilities of the present general inventive concept are achieved by providing an image forming apparatus including a main body provided with first electrical contacts at a sidewall therein; an image carrying unit removably mountable into the main body and including second electrical contacts at a side thereof to make an electrical contact with the first electrical contacts; and a guide device to guide the image carrying unit into the main body while shifting the image carrying unit such that the sidewall having the first electrical contacts is separated by a distance from the side of the image carrying part when the image carrying unit begins to be mounted into the main body and the sidewall having the first electrical contacts comes into contact with the side of the image carrying part when the image carrying unit becomes fully mounted into the main body.

The guide device may include first tracks disposed within the image forming apparatus at an angle and second tracks disposed on a bottom surface of the image carrying unit to engage with the first tracks to shift the image carrying unit in a sideways direction while simultaneously sliding being mounted in a forward direction into the image forming unit.

The first electrical contacts may be terminals which extend into an opening in the image forming apparatus in which the image carrying unit is mounted.

BRIEF DESCRIPTION OF THE DRAWINGS

These and/or other aspects and utilities of the exemplary embodiments of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
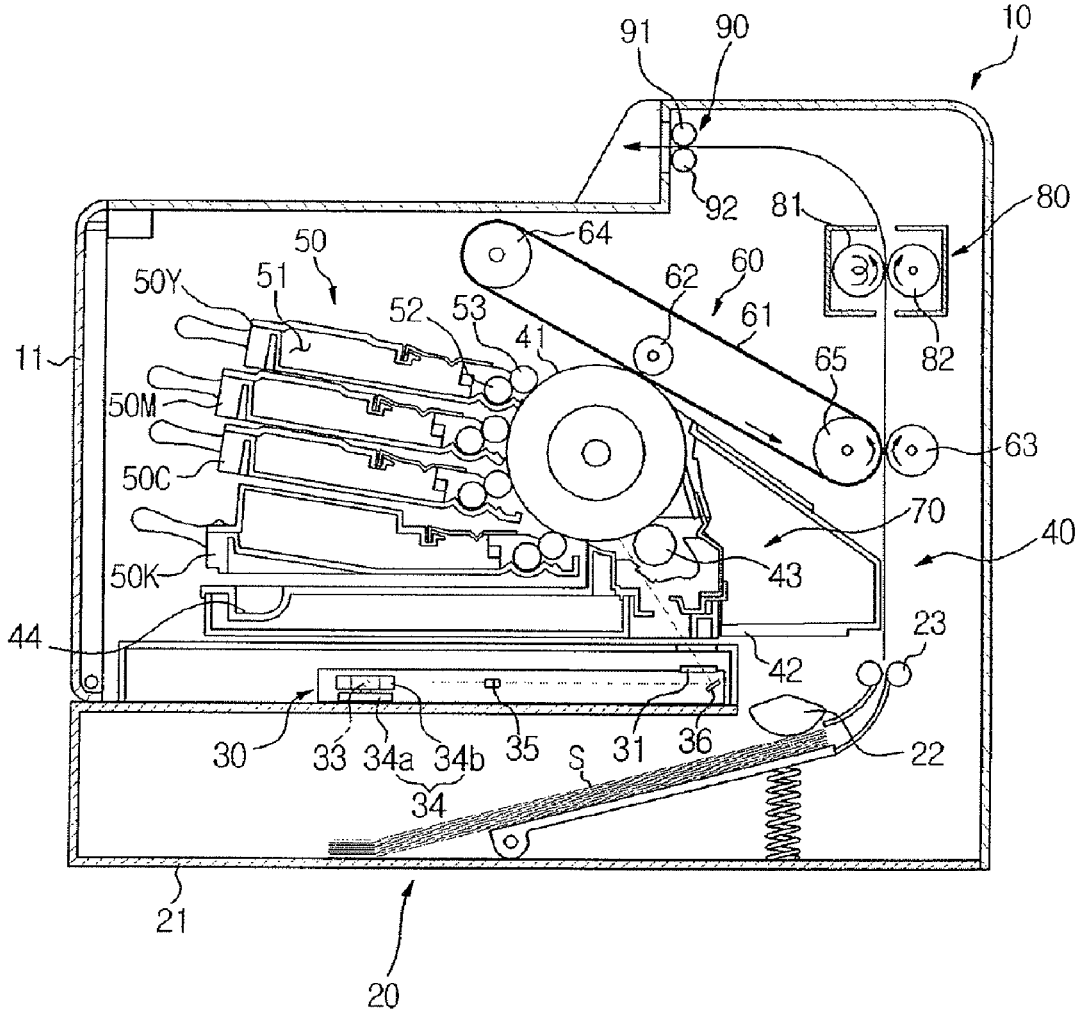
FIG. 1 is a sectional view showing constitution of an image forming apparatus according to an embodiment of the present general inventive concept.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

FIG. 1 is a sectional view showing constitution of an image forming apparatus according to an embodiment of the present general inventive concept. As shown in FIG. 1, an image forming apparatus may include a main body 10, a printing medium feeding unit 20, a laser scanning unit 30, a photosensitive body unit 40, a developing unit 50, a transfer unit 60, a developer storage unit 70, a fusing unit 80 and a printing medium discharge unit 90.

The main body 10 forms an exterior appearance of the image forming apparatus, and supports components mounted thereinside. A cover 11 is hingedly coupled to the main body 10 to expose and shield an opened portion of the main body 10. A user can open the cover 11 and can get access to the interior of the main body 10 through the opened portion of the main body 10.

The printing medium feeding unit 20 includes a cassette 21 to store a printing medium S, a pickup roller 22 to pick up the printing medium S in the cassette 21 sheet by sheet, and a feeding roller 23 to feed the picked-up printing medium S toward the transfer unit 60.

The laser scanning unit 30 includes a case 32 having a light transmitting member 31 so that light can be irradiated outside, and a scanning optical system mounted in the case 32.

The scanning optical system includes a light source 33 to emit light according to an image signal, an optical deflector 34 to deflect the light emitted from the light source 33, an f-theta (fθ) lens 35 to correct aberration included in the light deflected from the optical deflector 34, and a mirror 36 to reflect the light passing through the f-theta (fθ) lens 35 toward a photosensitive body 41.

The optical deflector 34 includes a driving motor 34*a*, and a polygon mirror 34*b* which is rotated by the driving motor 34*a*. The polygon mirror 34*b* has plural reflecting surfaces at a side portion to deflection-scan the light incident from the light source 33.

The light emitted from the light source 33 is deflected by the rotating polygon mirror 34*b*, and is reflected toward the light transmitting member 31 by the mirror 36 via the f-theta lens 35. The light reflected from the mirror 36 passes through the light transmitting member 31, and is irradiated to the outside of the case 32. Then, the light is transmitted to the photosensitive body 41 provided at a predetermined portion of the laser scanning unit 30, and forms an electrostatic latent image on the surface of the photosensitive body 41.

The photosensitive body unit 40 includes the aforementioned photosensitive body 41, a photosensitive body housing 42 and a charging roller 43.

The photosensitive body 41 is rotatably mounted in the photosensitive body housing 42, and is charged to a predetermined electric potential by the charging roller 43 before the laser scanning unit 30 scans light to the photosensitive body 41.

The photosensitive body housing 42 has a knob part 44, which is concavely formed at a rear portion of the photosensitive body housing 42. When a user mounts or dismounts the photosensitive body unit 40, the knob part 44 enables a user to easily grasp the photosensitive body unit 40.

The developing unit 50 includes four developing devices 50Y, 50M, 50C and 50K, in which developers of different colors from each other, e.g., yellow (Y), magenta (M), cyan (C) and black (K), are respectively stored. The developing unit 50 supplies the developers to the photosensitive body 41, on which an electrostatic latent image is formed, to develop the electrostatic latent image into a visible image.

Each of the developing devices 50Y, 50M, 50C and 50K includes a developer storage part 51, a supply roller 52 and a developing roller 53. The developer storage part 51 stores a developer to be supplied to the photosensitive body 41. The supply roller 52 supplies the developer stored in the developer storage part 51 to the developing roller 53. The developing roller 53 attaches the developer to the surface of the photosensitive body 41 on which the electrostatic latent image is formed.

The transfer unit 60 is an image carrying unit, similar to the photosensitive body unit 50. The transfer unit 60 includes an intermediate transfer belt 61, a first transfer roller 62 and a second transfer roller 63. The intermediate transfer belt 61 is supported by support rollers 64 and 65, and runs at the same velocity as a rotational linear velocity of the photosensitive body 41. The first transfer roller 62 opposes the photosensitive body 41 while the intermediate transfer belt 61 is interposed between the first transfer roller 62 and the photosensitive body 41, and transfers the visible image formed on the photosensitive body 41 onto the intermediate transfer belt 61. The second transfer roller 63 opposes the support roller 65 while the intermediate transfer belt 61 is interposed between the second transfer roller 63 and the support roller 65. While the image is transferred onto the intermediate transfer belt 61 from the photosensitive body 41, the second transfer roller 63 is spaced apart from the intermediate transfer belt 61. When the image is completely transferred onto the intermediate transfer belt 61 from the photosensitive body 41, the second transfer roller 63 comes into contact with the intermediate transfer belt 61 with a predetermined pressure. When the second transfer roller 63 is contacted with the intermediate transfer belt 61, the image on the intermediate transfer belt 61 is transferred onto the printing medium.

After the developing and transfer processes of one cycle are completed, a residual developer on the surface of the photosensitive body 41 is collected and stored in the developer storage unit 70. In this embodiment, the developer storage unit 70 is provided integrally with the photosensitive body unit 40. However, the developer storage unit 70 may be provided separately from the photosensitive body unit 40.

The fusing unit 80 includes a heating roller 81 having a heat source, and a press roller 82 mounted while opposing the heating roller 81. While the printing medium passes between the heating roller 81 and the press roller 82, the image is fused to the printing medium by heat transferred from the heating roller 81 and pressure exerted between the heating roller 81 and the press roller 82.

The printing medium discharge unit 90 includes a discharge roller 91 and a discharge backup roller 92, so as to discharge the printing medium having passed through the fusing unit 80 to the outside of the main body 10.

The operation of the above-constituted image forming apparatus will now be explained. At the beginning of the printing operation, the surface of the photosensitive body 41 is uniformly charged by the charging roller 43. The laser scanning unit 30 irradiates light corresponding to image information of any one color, e.g., yellow, to the uniformly charged surface of the photosensitive body 41, and an electrostatic latent image corresponding to the yellow image is formed on the photosensitive body 41.

A developing bias is applied to the developing roller 53 of the yellow developing device 50Y, and the yellow developer is attached to the electrostatic latent image. The electrostatic latent image is developed into a yellow visible image on the photosensitive body 41. The visible image is transferred onto the intermediate transfer belt 61 by the first transfer roller 62.

If the yellow visible image corresponding to one page is completely transferred, the laser scanning unit 30 scans light corresponding to image information of another color, e.g., magenta, to the photosensitive body 41 to form an electrostatic latent image corresponding to the magenta image. The magenta developing device 50M supplies the magenta developer to the electrostatic latent image to develop the electrostatic latent image into a magenta visible image. The magenta visible image formed on the photosensitive body 41 is transferred onto the intermediate transfer belt 61 by the first transfer roller 62, and is overlapped with the yellow visible image which has been already transferred.

Thereafter, if the visible images of cyan and black are sequentially transferred onto the intermediate transfer belt 61 through the same procedures as above, a color visible image is formed on the intermediate transfer belt 61 by the visible images of yellow, magenta, cyan and black being overlapped. The color visible image is transferred onto the printing medium S passing between the intermediate transfer belt 61 and the second transfer roller 63. Then, the printing medium S is discharged to the outside of the main body 10 via the fusing unit 80 and the printing medium discharge unit 90.

In the above image forming process, the image forming apparatus sometimes has troubles such as a printing medium jam, wear and tear of the components, or the like. When such troubles occur, it is necessary to demount the components, such as the photosensitive body unit 40, the developing unit 50 and the transfer unit 60, in order to repair or replace the components. Of the removable units, such as the photosensitive body unit 40, the developing unit 50 and the transfer unit 60, a mounting/demounting structure of the photosensitive body unit 40 will be exemplarily explained hereinafter.

Figure 2:
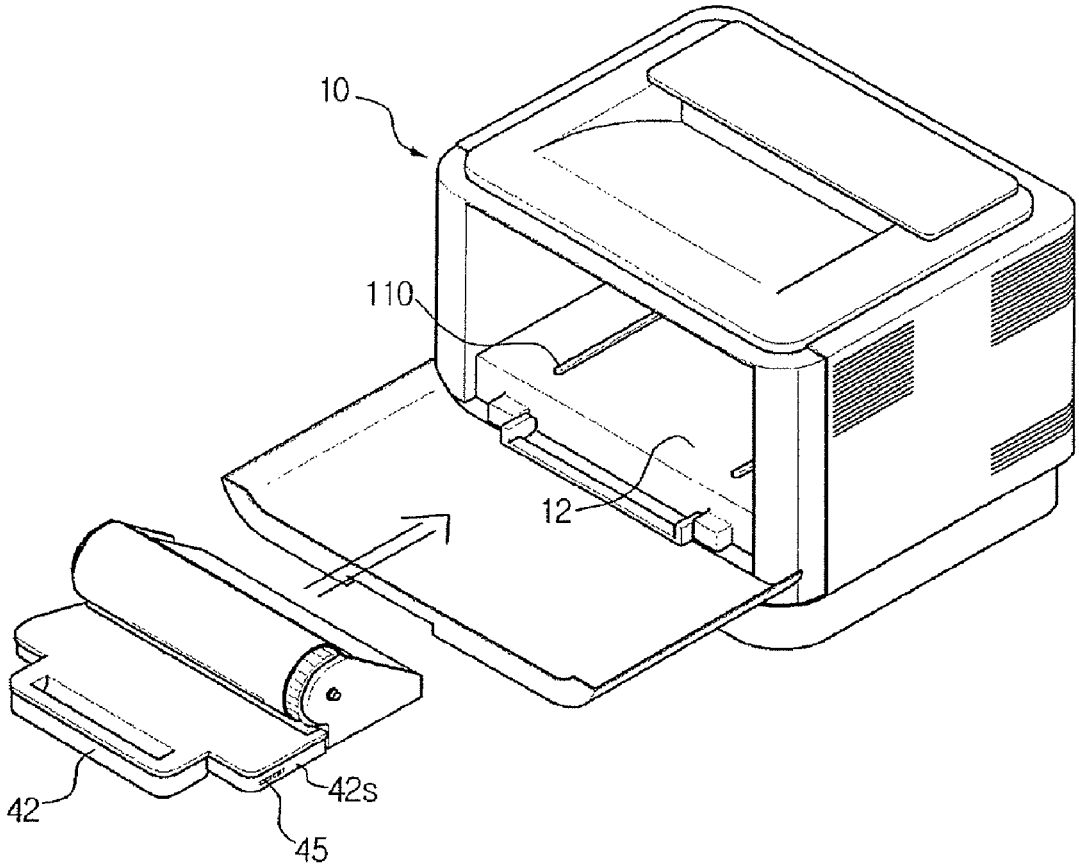
FIG. 2 is a perspective view showing a state of separating a photosensitive body unit from a main body of the image forming apparatus according to the embodiment of FIG. 1.
Figure 3:
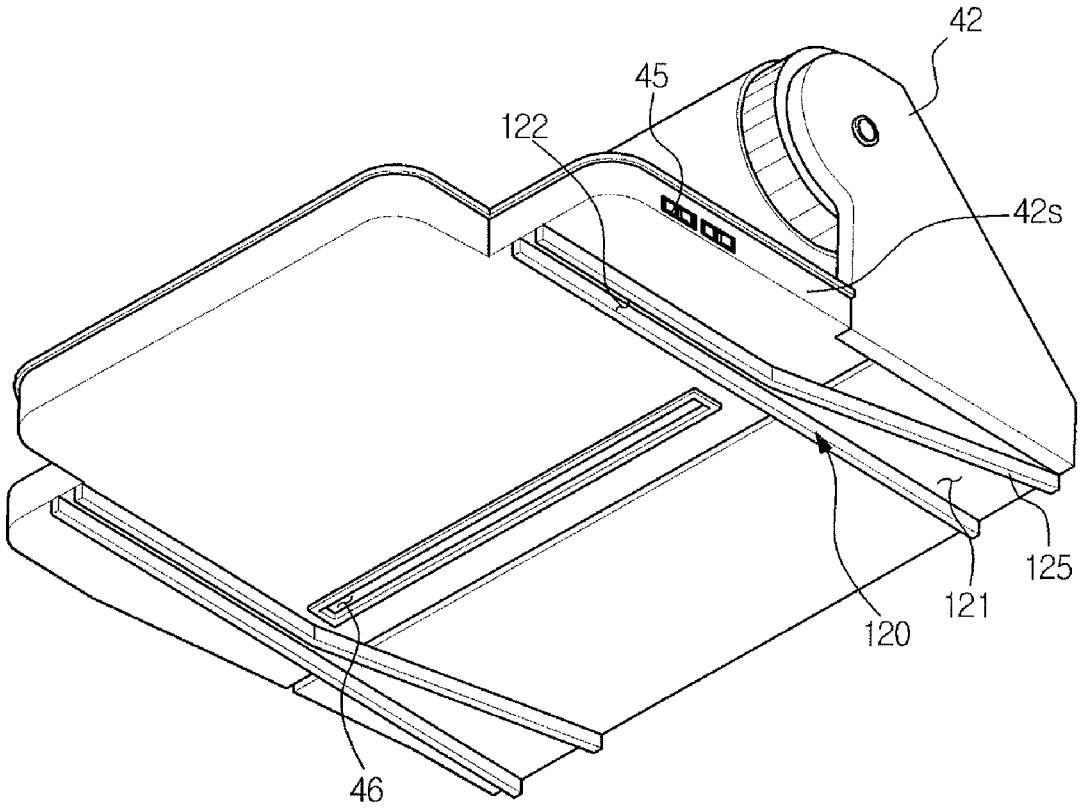
FIG. 3 is a perspective view showing the photosensitive body unit of the image forming apparatus according to the embodiment of FIG. 1.

FIG. 2 is a perspective view showing a state of separating the photosensitive body unit from the main body of the image forming apparatus according to an embodiment of the present general inventive concept, FIG. 3 is a perspective view showing the photosensitive body unit of the image forming apparatus according to the embodiment of FIG. 2, and FIGS. 4A-4C are views schematically showing a mounting/demounting structure and a coupling operation between the main body and the photosensitive body unit of the image forming apparatus according to the embodiment of FIG. 2.

As shown in FIGS. 2 to 4C, the photosensitive body housing 42 is provided with contacts 45 at one side surface 42*s*, and the main body 10 is provided with terminals 15 at an inner side surface 10*s*. The terminals 15 protrude from the inner side surface 10*s* of the main body 10, and can move forward and backward within a predetermined range. When the photosensitive body unit 40 is in the main body 10, the terminals 15 and the contacts 45 are electrically connected to each other. Accordingly, it can be determined whether the photosensitive body unit 40 is in the main body 10 or not, and the electrical control for electronic elements mounted in the photosensitive body unit 40 can be achieved.

Because the terminals 15 are provided to protrude from the inner side surface 10*s* of the main body 10, the terminals 15 may suffer abrasion or damage when the photosensitive body unit 40 is mounted or demounted. Therefore, in order to minimize abrasion and prevent damage of the terminals 15, the image forming apparatus according to the present general inventive concept further includes a guide device 100 to guide the photosensitive body unit 40 in an insertion direction X and a lateral direction Y (refer to FIGS. 4A-4C). The insertion direction X refers to a direction directed from the front surface of the main body 10 to the rear surface of the main body 10 (a direction parallel to the inner side surface 10*s* of the main body 10). The lateral direction Y refers to a direction perpendicular to the insertion direction X (a direction directed from the center portion of the main body 10 to the inner side surface 10*s* of the main body 10). A light window 46 is formed at the photosensitive body housing 42 so that the light scanned from the laser scanning unit 30 can be transmitted to the photosensitive body 41.

The guide device 100 includes at least one concave part 120 provided at the lower surface of the photosensitive body housing 42, and at least one convex part 110 provided at a plate 12 so as to be fitted into the concave part 120. The plate 12 is a component provided in the main body 10, to support the components, such as the photosensitive body unit 40.

In this embodiment, the convex part 110 is formed in a rail shape which extends in the insertion direction X. However, the shape of the convex part 110 is not limited to the rail shape. For example, the convex part may be formed to have a circular cross section.

The concave part 120 includes a first guide portion 121 and a second guide portion 122. Of two side surfaces defining the concave part 120, one side surface 125, which is positioned closer to the contacts 45 than the other side surface, gradually moves away from the side surface 42*s* mounted with the contacts 45 of the photosensitive body housing 42 as it goes from an inlet 121*a* of the first guide portion 121 to an inlet 122*a* of the second guide portion 122. The side surface 125 of the concave part 120 is parallel to the side surface 42*s* of the photosensitive body housing 42 in the second guide portion 122. In this embodiment, the side surface 125 of the concave part 120 is formed in a straight line shape in the first guide portion 121. However, the side surface 125 of the concave part 120 may be formed in a curved line shape in the first guide portion 121.

Figure 4A:
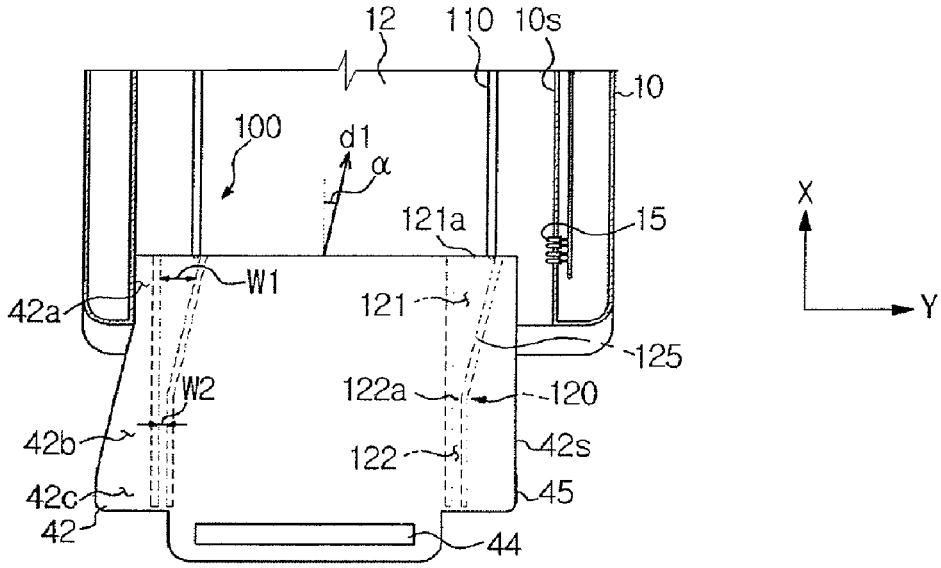
FIGS. 4A-4C are views schematically showing a mounting/demounting structure and a coupling operation between the main body and the photosensitive body unit of the image forming apparatus according to the embodiment of FIG. 1.
Figure 4B:
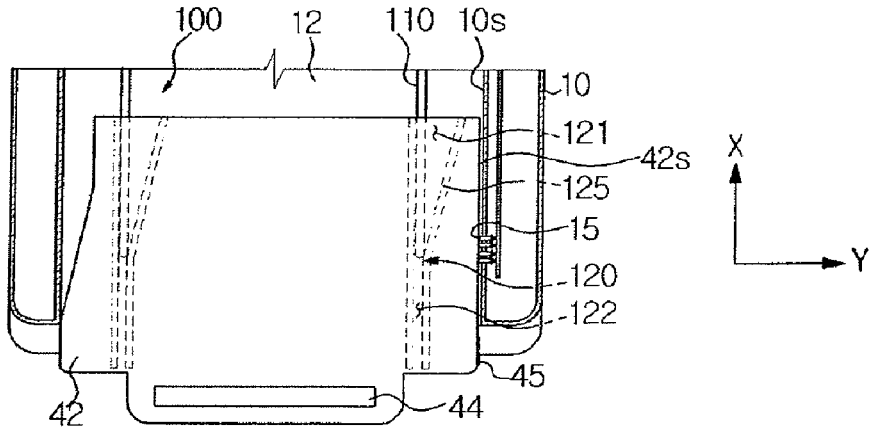
Figure 4C:
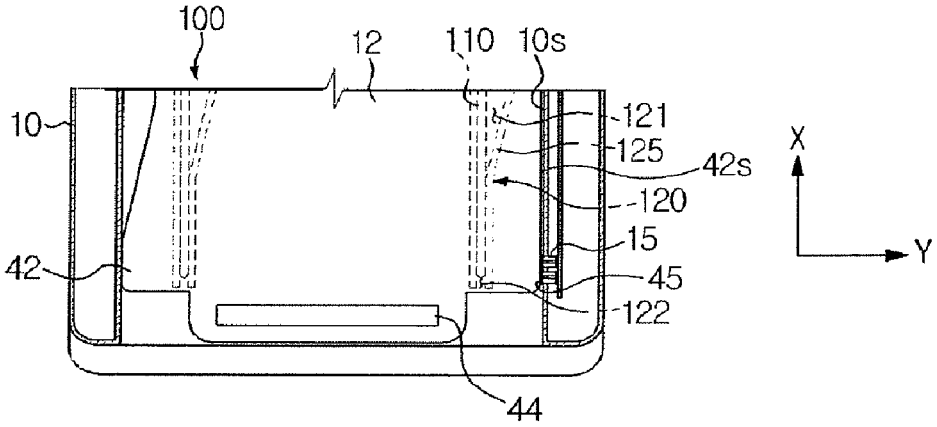

As shown in FIGS. 4A to 4C, while the front end portion of the convex part 110 is located adjacent to the side surface 125 of the first guide portion 121, if the photosensitive body unit 40 is pushed toward the main body 10, the photosensitive body unit 40 is moved in a slant line direction d1 at a predetermined inclination angle $\alpha$ from the insertion direction X by the first guide portion 121, and then is moved toward a mounting position in the insertion direction X in the second guide portion 122. As such, the photosensitive body unit 40 is inserted into the main body 10 in the insertion direction X and the lateral direction Y so that the photosensitive body unit 40 is spaced apart from the terminals 15 in the lateral direction Y. The photosensitive body housing 42 is not contacted to the terminals 15 until the photosensitive body unit 40 approaches closely the mounting position. Accordingly, since the sliding distance of the photosensitive body unit 40 while being contacted to the terminals 15 is reduced, abrasion of the terminals 15 is decreased. Further, since the photosensitive body unit 40 is moved in the slant line direction and thus gradually presses the terminals 15, damage that would normally be caused to the terminals 15 is prevented.

Moreover, since interference between the side surface 42*s* mounted with the contacts 45 of the photosensitive body housing and the inner side surface 10*s* mounted with the terminals 15 of the main body 10 is decreased, a user has an improved handling feeling while inserting the photosensitive body unit 40 into the main body 10.

Preferably, a width w1 of the first guide portion 121 gradually decreases in the direction of inserting the convex part into the first guide portion 121, that is, in the direction directed from the inlet 121*a* of the first guide portion 121 to the inlet 122*a* of the second guide portion 122. Preferably, a width w2 of the second guide portion 122 is uniform. Accordingly, the convex part 110 can be easily inserted into the first guide portion 121. Further, in the second guide portion 122 adjacent to the mounting position P, the stable guide for the photosensitive body unit 40 is guaranteed.

The photosensitive body housing 42 includes a first width portion 42*a*, an expanded portion 42*b* and a second width portion 42*c* according to a size of the width. The photosensitive body housing 42 is inserted into the main body 10 in order of the first width portion 42*a*, the expanded portion 42*b* and the second width portion 42*c*.

Particularly, while the first width portion 42*a* is in the main body 10, if the photosensitive body unit 40 is pushed into the main body 10, the photosensitive body unit 40 is guided in the slant line direction d1 by the first guide portion 121. In other words, the photosensitive body unit 40 is moved in the insertion direction X, and at the same time is moved in the lateral direction Y toward the terminals 15. Preferably, the expanded portion 42*b* of the photosensitive body housing 42 is increased in width in the direction opposite to the contacts 45, corresponding to a moving distance in the lateral direction Y of the photosensitive body unit 40. Thereafter, the photosensitive body housing 42 is moved in the insertion direction X in the second guide portion 122, and the second width portion 42*c* is inserted into the main body 10. Accordingly, the image forming apparatus according to the present invention can guide the photosensitive body unit in the lateral direction without increasing a width of the main body from a width of a main body of a conventional image forming apparatus, and an inner space of the main body of the image forming apparatus can be efficiently used.

Figure 5A:
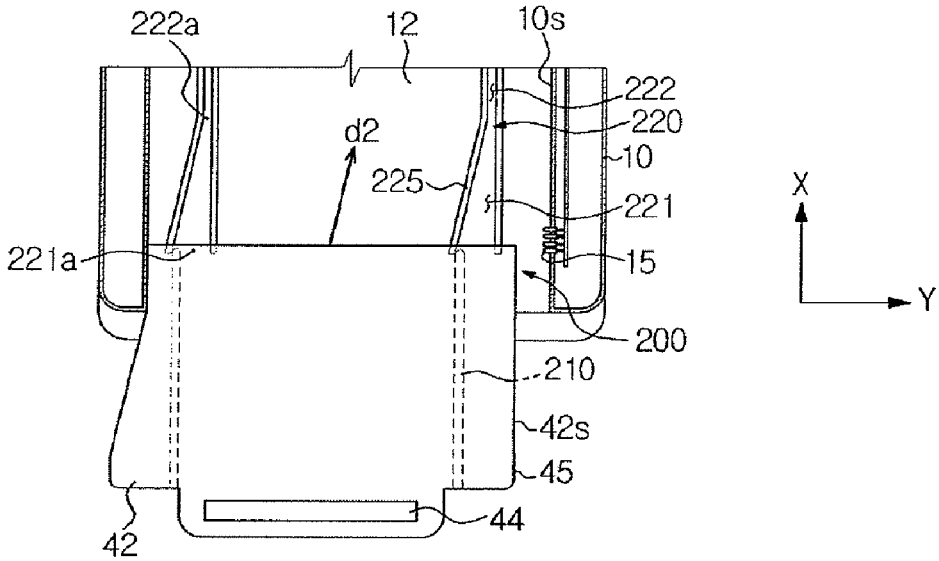
FIGS. 5A-5C are views schematically showing a mounting/demounting structure and a coupling operation between a main body and a photosensitive body unit of an image forming apparatus according to another embodiment of the present general inventive concept.
Figure 5B:
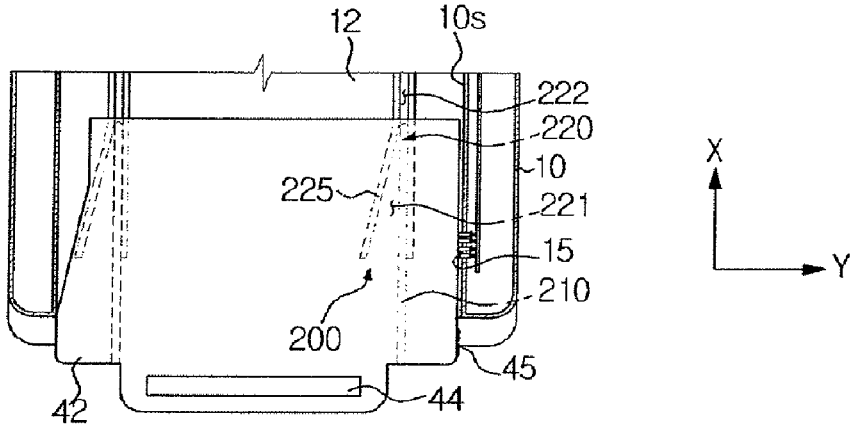
Figure 5C:
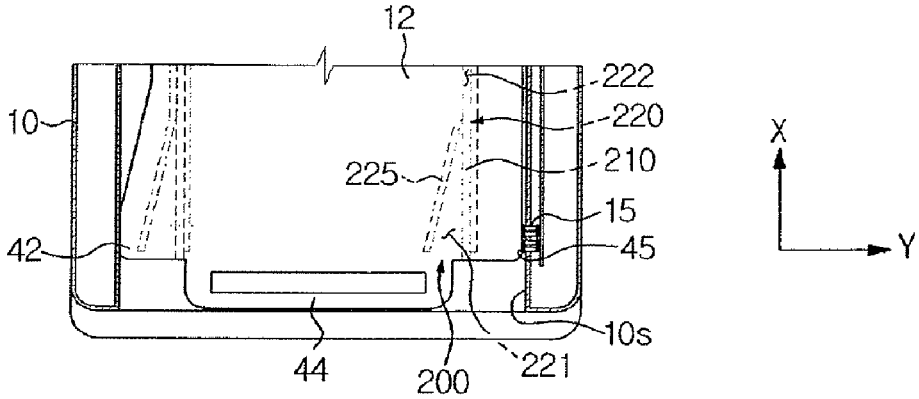

FIGS. 5A-5C are views schematically showing a mounting/demounting structure and a coupling operation between a main body and a photosensitive body unit of an image forming apparatus according to another embodiment of the present general inventive concept. Hereinafter, the same components as the components of the first embodiment will be denoted by the same reference numerals, and explanation of the components having the technical features identical or corresponding to the components of the first embodiment will be omitted.

As shown in FIGS. 5A to 5C, an image forming apparatus of this embodiment includes a guide device 200 including at least one convex part 210 and at least one concave part 220. Different from the exemplary embodiment of FIG. 2, the concave part 220 is provided at the plate 12, and the convex part 210 fitted into the concave part 220 is provided at the lower surface of the photosensitive body housing 42.

Of two side surfaces defining the concave part 220, one side surface 225, which is positioned more distant from the terminals 15 than the other side surface, is formed to be bent. Particularly, the side surface 225 of the concave part 220 gradually gets closer to the inner side surface 10*s* mounted with the terminals 15 of the main body 10 as it goes from an inlet 221*a* of a first guide portion 221 to an inlet 222*a* of a second guide portion 222. The side surface 225 of the concave part 220 is parallel to the inner side surface 10*s* of the main body 10 in the second guide portion 222. The front end portion of the convex part 210 slides along the side surface 225 in the first guide portion 221, and then is introduced into the second guide portion 222.

Accordingly, the photosensitive body unit 40 of this embodiment is guided in a slant line direction d2, that is, is guided in the insertion direction X and the lateral direction Y at the same time in the first guide portion 221, and is guided in the insertion direction X in the second guide portion 222.

Figure 6:
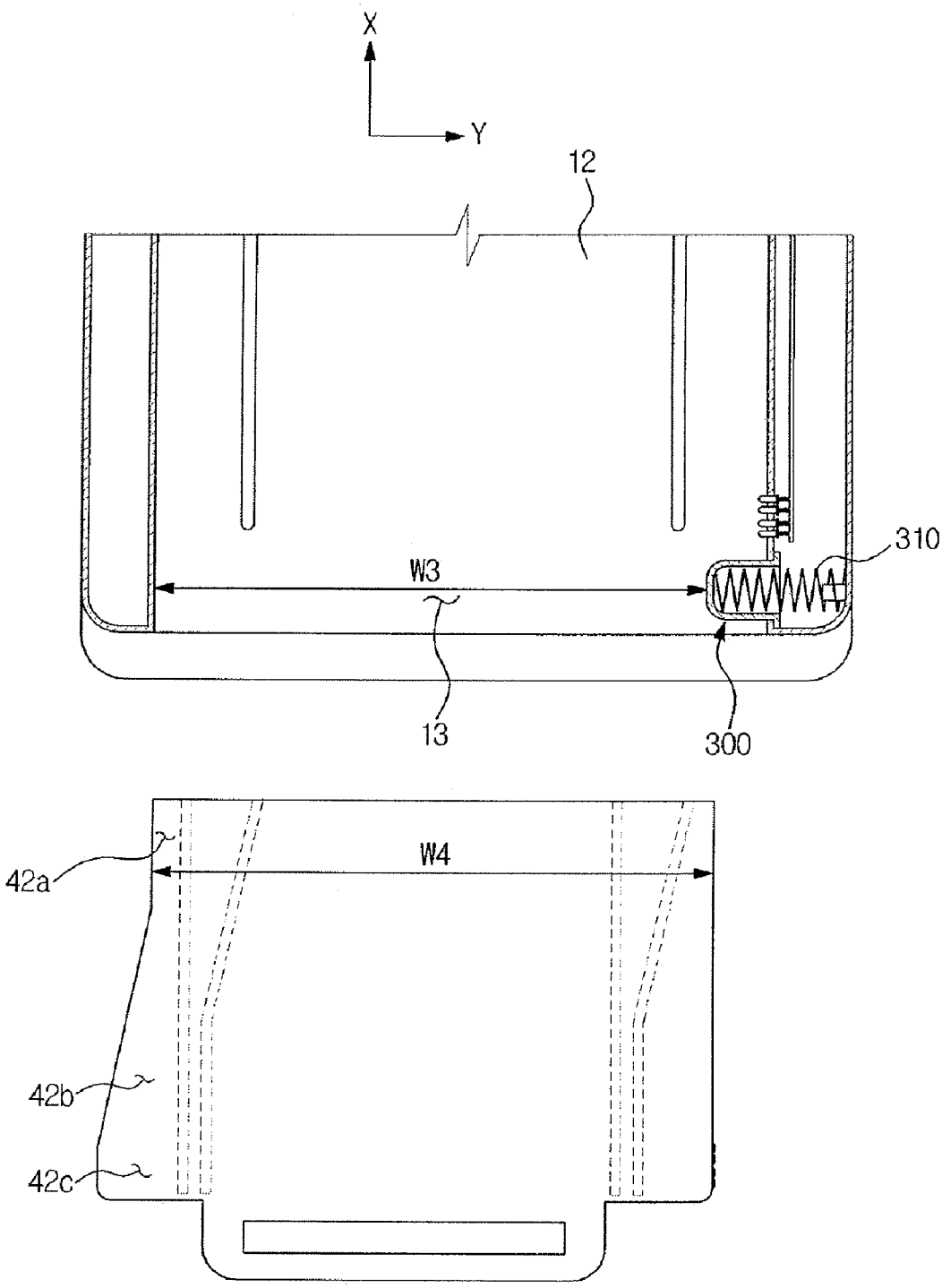
FIG. 6 is a view schematically showing a mounting/demounting structure and a coupling operation between a main body and a photosensitive body unit of an image forming apparatus according to yet another embodiment of the present general inventive concept.

FIG. 6 is a view schematically showing a mounting/demounting structure and a coupling operation between a main body and a photosensitive body unit of an image forming apparatus according to yet another embodiment of the present general inventive concept. Hereinafter, the same components as the components of the exemplary embodiment of FIG. 2 will be denoted by the same reference numerals, and explanation of the components having the technical features identical or corresponding to the components of the first embodiment will be omitted.

As shown in FIG. 6, an image forming apparatus of this embodiment further includes a moving member 300 which is provided at an opening portion 13 of the inner side surface 10*s* mounted with the terminals 15 of the main body 10. The moving member 300 is supported by an elastic member 310. When the photosensitive body unit 40 is inserted into the main body 10, the moving member 300 is pushed backward in the lateral direction Y by the photosensitive body unit 40.

The moving member 300 prevents the side surface 42*s* of the photosensitive body housing 42 from being contacted to the inner side surface 10*s* mounted with the terminals 15 of the main body 10 when the photosensitive body unit 40 is inserted into the main body 10. Preferably, a width w3 of the opening 13 defined by the main body 10 and the moving member 300 when the elastic member 310 is in a non-compressed state is set to be equal to a width w4 of the first width portion 42*a* of the photosensitive body housing 42.

In the above description, the mounting/demounting structure between the photosensitive body unit 40 and the main body 10 has been exemplarily explained. However, the mounting/demounting structure according to the present invention can also be applied to the other removable units, such as the developing unit 50, the transfer unit 60 or the like.

As apparent from the above description, the image forming apparatus according to the various exemplary embodiments of the present general inventive concept can decrease abrasion of the terminals mounted to the main body, because the sliding distance of the removable unit while being contacted to the terminals is reduced. Further, since the removable unit is moved in a slant line direction and thus gradually presses the terminals, damage of the terminals is prevented.

Still further, since interference between the side surface mounted with the contacts of the removable unit and the inner side surface mounted with the terminals of the main body is decreased, a user has an improved handling feeling while mounting or demounting the removable unit into/from the main body.

Although various exemplary embodiments of the present general inventive concept have been shown and described, it would be appreciated by those skilled in the art that changes may be made in this embodiment without departing from the principles and spirit of the general inventive concept, the scope of which is defined in the claims and their equivalents.

What is claimed is:

1. An image forming apparatus comprising:

a main body provided with a first electrical connecting part configured as a terminal provided on an inner side surface of the main body and is movably forward and backward from the inner side surface;

a removable unit removably mounted in the main body, the removable unit being provided with a second electrical connecting part configured as a contact provided at a side portion of the removable unit, the removable unit including a concave part having two side surfaces, a first guide portion and a second guide portion defined by the side surfaces, wherein one side surface of the concave part, which is positioned closer to the contact than the other side surface, gradually moves away from the side portion mounted with the contact of the removable unit as it goes from an inlet of the first guide portion to an inlet of the second guide portion, and is formed parallel to the side portion of the removable unit in the second guide portion;

a guide device to guide the removable unit in an insertion direction and a lateral direction in which the removable unit is guided towards the inner side surface when the removable unit is guided in the lateral direction so that the second electrical connecting part of the removable unit is connected to the first electrical connecting part of the main body, the first electrical connecting part protruding from the inner side surface in a direction opposite to the lateral direction.

2. The image forming apparatus according to claim 1, wherein the guide device includes at least one convex part provided at any one of the main body and the removable unit, and at least one concave part provided at the other one of the main body and the removable unit, and wherein the convex part is fitted and guided in the concave part.

3. The image forming apparatus according to claim 2, wherein the convex part extends in the insertion direction.

4. The image forming apparatus according to claim 2, wherein the concave part includes a first guide portion and a second guide portion, and wherein, when the removable unit is inserted into the main body, the removable unit is initially guided in a slant line direction in the first guide portion, and then is guided in the insertion direction in the second guide portion.

5. The image forming apparatus according to claim 1, wherein the removable unit includes an expanded portion in which a width is expanded.

6. The image forming apparatus according to claim 1, further comprising:

a moving member provided at an opening portion of the inner side surface mounted with the first electrical connecting part of the main body.

7. The image forming apparatus according to claim 6, wherein the moving member extends in the direction opposite to the lateral direction and is configured to bias the image carrying unit in the direction opposite to the lateral direction.

8. An image forming apparatus comprising:

a main body;

a removable unit removably mounted in the main body;

a contact provided at a portion of the removable unit;

a terminal provided at an inner side surface of the main body, the terminal being connected to the contact when the removable unit is in the main body; and a guide device to guide the removable unit to a mounting position, whereby the removable unit begins being inserted into the main body in an insertion direction while the removable unit is spaced apart from the terminal in a lateral direction substantially perpendicular to the insertion direction, and then the removable unit is guided in the lateral direction towards the inner side surface and the contact is connected to the terminal when the removable unit closely approaches the mounting position, the terminal protruding from the inner side surface in a direction opposite to the lateral direction.

9. The image forming apparatus according to claim 8, wherein the guide device includes a first guide portion and a second guide portion, and wherein the removable unit is moved in an insertion direction and a lateral direction in the first guide portion, and is moved in the insertion direction in the second guide portion.

10. The image forming apparatus according to claim 8, wherein the guide device includes at least one rail part provided at any one of the removable unit and the main body, and at least one concave part provided at the other one of the removable unit and the main body, and wherein the rail part is fitted and guided in the concave part.

11. The image forming apparatus according to claim 10, wherein the concave part has a width which gradually decreases in a predetermined region and is uniform from the predetermined region in a direction of inserting the rail part into the concave part.

12. An image carrying unit removably mounted in a main body of an image forming apparatus, the image carrying unit comprising:

a contact provided at a portion of the image carrying unit; and a guide device to guide the image carrying unit to be moved in an insertion direction and a lateral direction in which the image carrying unit is guided towards an inner side surface of the main body when the image carrying unit is guided in the lateral direction so that the contact is connected to a terminal provided at the main body of the image forming apparatus and that protrudes from the inner side surface of the main body in a direction opposite to the lateral direction.

13. The image carrying unit according to claim 12, wherein the guide device includes a concave part in which a convex part provided at the main body of the image forming apparatus is fitted.

14. The image carrying unit according to claim 13, wherein the image carrying unit is formed integrally with a developer storage unit.

15. A removable unit removably mounted in a main body of an image forming apparatus, the removable unit comprising:

a contact provided at a side portion of the removable unit, the contact being connected to a terminal provided on an inner side surface of the main body when the removable unit is in the main body; and a concave part connected with a convex part provided at the main body to guide the removable unit to a mounting position, whereby the removable unit begins being inserted into the main body in an insertion direction while the removable unit is spaced apart from the terminal in a lateral direction substantially perpendicular to the insertion direction, and then the removable unit is guided in the lateral direction towards the inner side surface and the contact is connected to the terminal when the removable unit closely approaches the mounting position, the terminal protruding from the inner side surface in a direction opposite to the lateral direction.

16. An image forming apparatus comprising:

a main body provided with first electrical contacts at a sidewall therein;

an image carrying unit removably mountable into the main body and including second electrical contacts at a side thereof to make an electrical contact with the first electrical contacts; and a guide device to guide the image carrying unit into the main body in an insertion direction while shifting the image carrying unit in a lateral direction substantially perpendicular to the insertion direction such that the sidewall having the first electrical contacts is separated by a distance from the side of the image carrying part in the lateral direction when the image carrying unit begins to be mounted into the main body, and the image carrying unit is guided in the lateral direction towards the sidewall and the sidewall having the first electrical contacts comes into contact with the side of the image carrying part when the image carrying unit becomes fully mounted into the main body, the first electrical contacts protruding from the sidewall in a direction opposite to the lateral direction.

17. The image forming apparatus according to claim 16, wherein the guide device comprises:

first tracks disposed within the image forming apparatus at an angle; and second tracks disposed on a bottom surface of the image carrying unit to engage with the first tracks to shift the image carrying unit in a sideways direction while simultaneously sliding being mounted in a forward direction into the image forming unit.

18. The image forming apparatus according to claim 16, wherein the first electrical contacts are terminals which extend into an opening in the image forming apparatus in which the image carrying unit is mounted.

* * * * *